United States Patent [19]

Winston

[11] Patent Number: 4,490,952

[45] Date of Patent: Jan. 1, 1985

[54] APPARATUS FOR ELIMINATING MOISTURE

[76] Inventor: Emanuel A. Winston, 190A Skokie Valley Rd., Highland Park, Ill. 60035

[21] Appl. No.: 337,017

[22] Filed: Jan. 4, 1982

[51] Int. Cl.[3] ..... E04H 12/28

[52] U.S. Cl. ..... 52/199; 52/302

[58] Field of Search ..... 52/302, 310, 199, 303, 52/96, 309.7, 309.16; 428/247, 255

[56] References Cited

U.S. PATENT DOCUMENTS

| | | | |
|---|---|---|---|
| 1,953,621 | 4/1934 | Masters | 52/310 X |
| 2,788,053 | 4/1957 | Dolbey et al. | 52/310 X |
| 3,483,664 | 12/1969 | Funk et al. | 52/309.6 |
| 3,756,895 | 9/1973 | Bellamy | 52/199 X |
| 3,984,947 | 10/1976 | Patry | 52/199 X |

*Primary Examiner*—Henry E. Raduazo
*Attorney, Agent, or Firm*—Frijouf, Rust & Pyle

[57] ABSTRACT

An apparatus is disclosed for eliminating moisture from a moist-prone area such as an insulated roof or the like. The invention comprises a grid of hydrophilic material adjacent the moisture prone area. The grid comprises a first set of longitudinally extending hydrophilic elements and a second set of longitudinally extending hydrophilic elements disposed in a transverse relationship to the first set of hydrophilic elements. The grid enables moisture to travel along the first and second set of hydrophilic elements by capillary action. A vent is included for venting moisture accumulated in the first and second set of hydrophilic elements to remove moisture thereby.

10 Claims, 12 Drawing Figures

APPARATUS FOR ELIMINATING MOISTURE

BACKGROUND OF THE INVENTION

1. Field of the Invention

This invention relates to an apparatus for eliminating moisture within a static or dynamic structure.

2. Description of the Prior Art

The elimination of moisture in a static or a dynamic structure such as an insulated area has been a substantial difficulty for the prior art. In building structures, the accumulation of moisture causes severe problems in the building industry as is well known to those skilled in the art. This accumulated moisture can result in deterioration of structural members as well as reducing the insulative properties of moisture ridden insulation. Moisture also presents a substantial hazard to electrical circuits as well as other building elements and structures. The accumulation of undesired moisture has presented architects of buildings with severe design considerations which must be considered in the design of the building.

Various types of apparati and methods have been proposed by the prior art for reducing or eliminating the accumulation of moisture within buildings and roof structures. U.S. Pat. No. 1,353,621 to Masters disclosed a channel having a plurality of weep holes enclosing a fiberous material therein and disposed between lapped roofing plates.

U.S. Pat. No. 2,438,528 to Wilhelm et al discloses an apparatus molded in concrete utilizing draining strips having a free end exposed through an end opening of the concrete. The draining strips incorporate a wetting agent on the outer surface thereof for facilitating the propagation of moisture thereto.

U.S. Pat. No. 2,625,729 illustrates a roofing board arranged in piles with an aggregate disposed therebetween.

U.S. Pat. No. 3,203,146 to Carter teaches the use of a wall construction utilizing a vapor permeable board for enabling the moisture in the cementitious-type material to escape therefrom.

U.S. Pat. No. 3,498,015 to Seaburg et al, discloses a poured gypsum roof structure utilizing a roof material for removing moisture.

Although the aforementioned patents have solved many of the needs in the prior art for eliminating moisture, many of these devices required specially fashioned component parts for use in the building structure. None of the structures incoporated readily available materials that could be installed on a building structure without the need for special techniques or methods. Accordingly, the cost of these prior art devices prohibited use in many applications, and were not well known and widely accepted by the building industry.

Therefore, it is an object of this invention to provide an apparatus which overcomes the aforementioned inadequacies of the prior art devices and provides an improvement which is a significant contribution to the advancement of the moisture-eliminating art.

Another object of this invention is to provide an apparatus for eliminating moisture incorporating a grid of hydrophilic material comprising a first and second set of longitudinally extending hydrophilic elements in a transverse relationship enabling the moisture to travel along the hydrophilic grid by capillary action.

Another object of this invention is to provide an apparatus for eliminating moisture incorporating a vent in fluid communication with the hydrophilic grid for enabling the moisture accumulated within the grid to flow toward a vent to reduce moisture thereby.

Another object of this invention is to provide an apparatus for eliminating moisture incorporating a third set of hydrophilic elements at least partially exposed to the ambient and in fluid communication with the hydrophilic grid for enabling evaporation of the accumulated moisture.

Another object of this invention is to provide an apparatus for eliminating moisture utilizing a vapor impervious shield for enclosing the hydrophilic grid elements with first aperture means intermittently disposed in the vapor impervious shield for enabling moisture to enter into the grid and with second aperture means disposed in the vapor impervious shield for enabling moisture to evaporate from the grid.

The foregoing has outlined some of the more pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description describing the preferred embodiment in addition to the scope of the invention defined by the claims taken in conjunction with the accompanying drawings.

SUMMARY OF THE INVENTION

The invention is defined by the appended claims with a specific embodiment shown in the attached drawings. For the purpose of summarizing the invention, the invention may be incorporated into an apparatus for eliminating moisture in a moisture prone area comprising a grid of hydrophilic material disposed adjacent the moisture ridden area. The hydrophilic grid comprises a first set of longitudinally extending hydrophilic elements with a second set of longitudinally extending hydrophilic elements disposed in a transverse relationship with the first set of hydropholic elements. The combination of the first and second sets of hydrophilic elements enable moisture to travel therealong by capillary action. Means are provided for venting the moisture absorbed by the first and second sets of hydrophilic elements to reduce the moisture in the moisture ridden area.

In a more specific embodiment of the invention, the venting means may include a third set of hydrophilic elements at least partially exposed to the ambient and in fluid communication with at least one of the first and second sets of hydrophilic elements for enabling evaporation of accumulated moisture thereby.

In another embodiment of the invention, the apparatus is associated with an insulated roof system having a waterproof covering thereon. The hydrophilic grid may be interposed between portions of the roof insulation or in the alternative, the hydrophilic grid may be located on a surface of the roof insulation and extend substantially parallel to the roof system. In another embodiment of the invention, the hydrophilic grid may be enclosed in a vapor-impervious shield with first aperture means intermittently disposed in the vapor-impervious shield to allow moisture to enter the grid. A second set of aperture means is disposed in the vapor-impervious shield to enable evaporation of moisture from the hydrophilic grid.

Various types of venting means may be incoporated within the aforementioned apparatus for the venting of the accumulated moisture from the hydrophilic grid. The vent may include an aperture in communication with a vent pipe extending through the insulation of the roof system. In the alternative, the grid may be disposed adjacent a preexisting vent in the building structure. Various types of vents may be employed with the novel hydrophilic grid for eliminating moisture from a moisture prone area.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION

Figure 1:
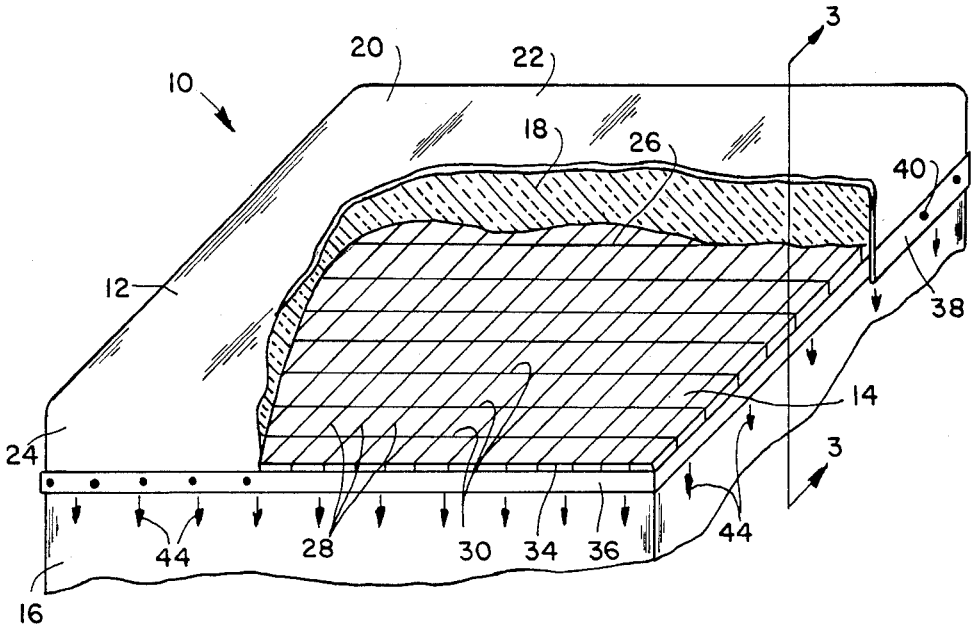
FIG. 1 is an isometric view of a first embodiment of an apparatus for eliminating moisture in an insulating roof system.

FIG. 1 is an isometric view of an apparatus 10 for eliminating moisture from within a moisture prone area which is shown as an insulated roof system 12 for a roof deck 14 having sidewalls 16. The insulated roof system 12 has insulation 18 shown as conventional fiberglass but urethane or other conventional insulation may be used, depending on the particular application. Although the invention is shown in this embodiment as an apparatus 10 for eliminating moisture in an insulated roof system 12, it should be understood by those skilled in the art that the present invention finds application in various systems where the accumulation of moisture is a persistent problem. Some examples of other applications of the present invention, which are not to be construed as limiting, include refrigerators, mobile homes, recreational vehicles, freezers, air conditioning units and other static and dynamic structures.

The insulating roof system 12 includes a waterproof covering 20, in this embodiment shown as a flexible waterproof covering, having an upper portion 22 and a side portion 24 extending to partially cover the sidewall 16. Although the insulating roof system 12 has been shown with a flexible waterproof covering 20, it should be appreciated by those skilled in the art that other conventional waterproof coverings which are rigid or built-up roof coverings may be utilized with the present invention.

The apparatus 10 includes a grid 26 of hydrophilic material disposed adjacent the moisture prone area. Within the meaning of this specification, the term "hydrophilic" means the ability of the material to absorb water or moisture and to propagate the water or moisture along the hydrophilic material by capillary action. The hydrophilic grid 26 comprises a first set of longitudinally extending hydrophilic elements 28 and a second set of longitudinally extending hydrophilic elements 30. The first and second sets of hydrophilic elements 28 and 30 are established in a transverse relationship relative to one another enabling moisture absorbed by the hydrophilic grid 26 to travel in two dimensions along the first and second sets of hydrophilic elements 28 and 30 by capillary action. The hydrophilic grid 26 absorbs water from a moisture prone area in the roof system 12 and either distributes the moisture uniformly throughout the hydrophilic grid 26 or distributes the moisture in a preferred direction by capillary action. The alternative distribution of the moisture within the hydrophilic grid 26 by the capillary action is largely controlled by associated venting means which will be explained in more detail hereinafter.

Figure 3:
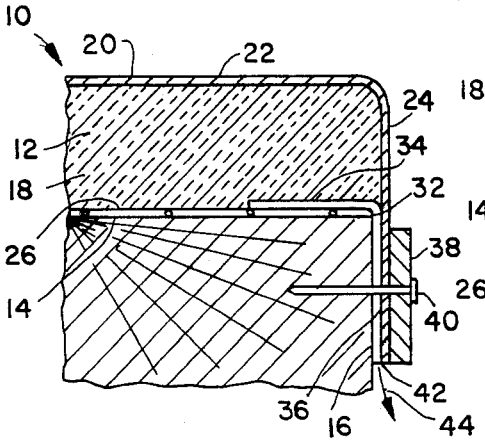
FIG. 3 is a partial side sectional view along line 3—3 in FIG. 1.

In the first embodiment, the vent means includes a third hydrophilic element 32, shown more clearly in FIG. 3. The third hydrophilic element 32 comprises a solid hydrophilic material which is in communication with the hydrophilic grid 26 and preferably in communication with both the first and second sets of hydrophilic elements 28 and 30. The third hydrophilic element 32 has a higher volumetric capacity for moisture than the volumetric capacity of the hydrophilic grid 26. The greater volumetric capacity for moisture of the third hydrophilic element 32 may be established by using a different hydrophilic material which has a greater affinity for moisture than the hydrophilic material used for the hydrophilic grid 26. In the alternative, the greater volumetric capacity for moisture of the third hydrophilic element 32 may be established by using a greater thickness than the hydrophilic grid 26. In a still further alternative, the greater volumetric capacity for moisture may be established by using a solid third hydrophilic element 32 in contrast to the hydrophilic grid 26 composed of the first and second sets of hydrophilic elements 28 and 30 with spaces therebetween. Any of the above alternatives, either singularly or in combination, may be used to establish the greater volumetric capacity of the third hydrophilic element 32. The greater volumetric capacity of the third hydrophilic element 32 relative to the hydrophilic grid 26 creates a moisture gradient causing moisture flow by capillary action from the hydrophilic grid 26 to the third hydrophilic element 32.

The third hydrophilic element 32 has a first portion 34 in fluid communication with the hydrophilic grid 26 in addition to a second portion 36 established along the sidewall 16. The waterproof covering 20 overlays the second portion 36 of the third hydrophilic element 32 with a flashing 38 securing the waterproof covering 20 to the sidewall 16 through a mechanical fastener 40 shown as a nail. The terminal end 42 of the third hydrophilic element 32 is exposed to the ambient thereby enabling evaporation of the accumulated moisture from the third hydrophilic element 32 as indicated by the arrows 44. Preferably, the third hydrophilic element 32 extends about the entire periphery of the insulated roof system 12 as shown in FIG. 1, enabling evaporation about the entire periphery of the building.

Figure 2:
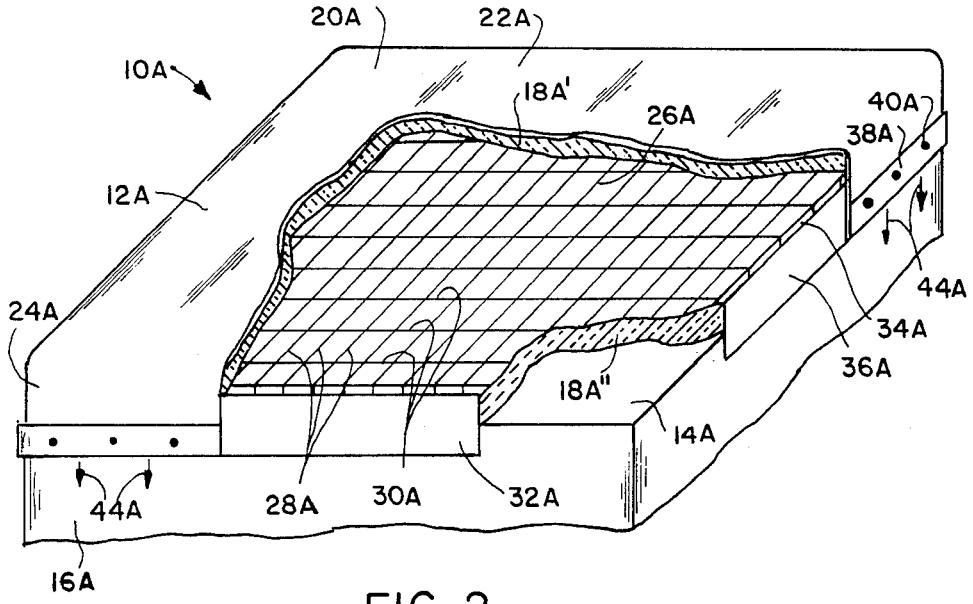
FIG. 2 is an isometric view of a second embodiment of the apparatus for eliminating moisture installed in an insulating roof system.

FIG. 2 is a second embodiment of the invention showing an apparatus 10A which is a modification of the apparatus shown in FIG. 1. Similar reference parts are referred to with similar reference characters followed by an A. In this embodiment, the insulated roof system 12A comprises an upper insulation 18A' and a lower insulation 18A" with the hydrophilic grid 26A disposed between the upper insulation 18A' and the lower insulation portion 18A". The hydrophilic grid 26A may be formed as a part of the two insulating sections 18A' and 18A" as a single unit or, in the alternative, separate insulating sections 18A' and 18A" may be used with the interposed hydrophilic grid 26A. This embodiment utilizes a similar waterproof covering 20A with the third hydrophilic element 32A in communication with the hydrophilic grid 26A. The second portion 36A of the third hydrophilic element 32A extends along the edge of the insulation 18A" to the sidewall 16A and is secured thereto in a manner similar to FIG. 3. The hydrophilic grid 26A similarly enables evaportion about the entire periphery of the building as illustrated by the arrows 44A.

Figure 4:
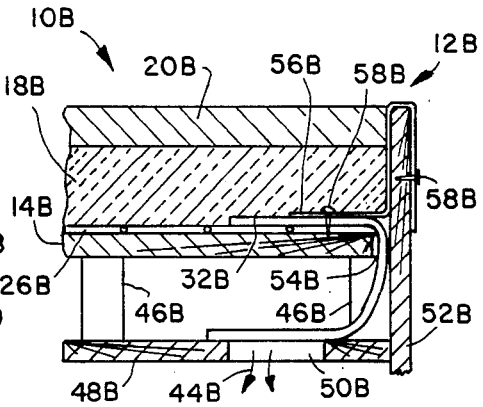
FIG. 4 is a modification of FIG. 3 showing an alternative venting means for the apparatus.

FIG. 4 illustrates an alternate embodiment of the novel venting means installed on an insulated roof system 12B with a rigid waterproof covering 20B. In this embodiment, the roof deck 14B is supported by members 46B with a lower sheet covering 48B disposed thereunder having a vent aperture 50B. A side sheet covering 52B is secured to the member 46B and the roof deck 14B for a built-up roof as is well known in the art. The lower sheet covering 48B is characteristic of a conventional soffit used on many residential and commercial buildings.

The hydrophilic grid 26B is disposed on the roof deck 14B with the third hydrophilic element 32B communicating with the grid 26B and extending through an aperture 54B in the roof deck 14B to be adjacent the aperture 50B. The third hydrophilic element 32B is held in place by a flashing 56B secured by conventional mechanical means shown as nails 58B with the flashing 56B extending over and around the side sheet covering 52B. The insulation 18B is disposed upon the hydrophilic grid 26B with the rigid waterproof covering 20B located thereon. It should be appreciated by those skilled in the art that the insulation 18B is rigid in nature to support the weight of the rigid waterproof covering 20B. It should also be understood that the hydrophilic grid 26B may be located below, above or interposed between insulation 18B. The aperture 50B enables evaporation of moisture from the third hydrophilic element 32B as shown by the arrows 44B.

Figure 5:
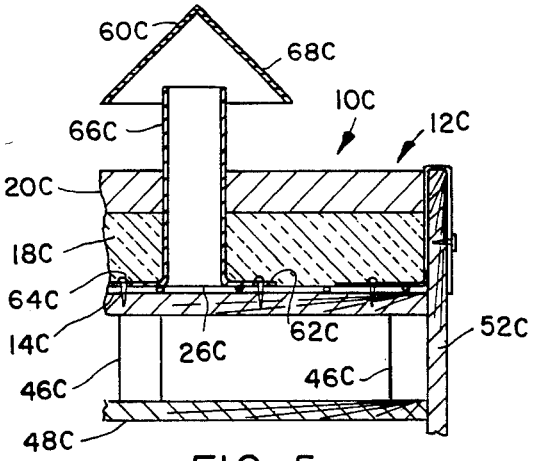
FIG. 5 is a further modification of FIG. 3 showing a second alternate venting means for the apparatus.

FIG. 5 illustrates still a further embodiment of vent means which is suitable for use with the present invention. This is a similar structure to FIG. 4 with similar parts having similar reference numerals followed by a C. In this embodiment, the venting means vents intermediate portions of the hydrophilic grid 26C through the use of a conventional roof vent 60C. A plurality of conventional roof vents 60C may be positioned in a preselected fashion on the roof deck 14C or may be intermittently disposed in areas which are moisture prone, depending upon the particular building structure. The roof vent 60C includes a flange 62C secured to the roof deck 14C by conventional metal fasteners such as nails 64C with an upstanding pipe 66C extending through the insulation 18C and the waterproof covering 20C and being protected by a vent cover 68C.

In this embodiment, the hydrophilic grid 26C is in direct communication with the roof vent 66C but it should be appreciated by those skilled in the art that a third hydrophilic element such as that shown in FIGS. 1–4 may be utilized below the upstanding pipe 66C of the vent 60C.

Figure 6:
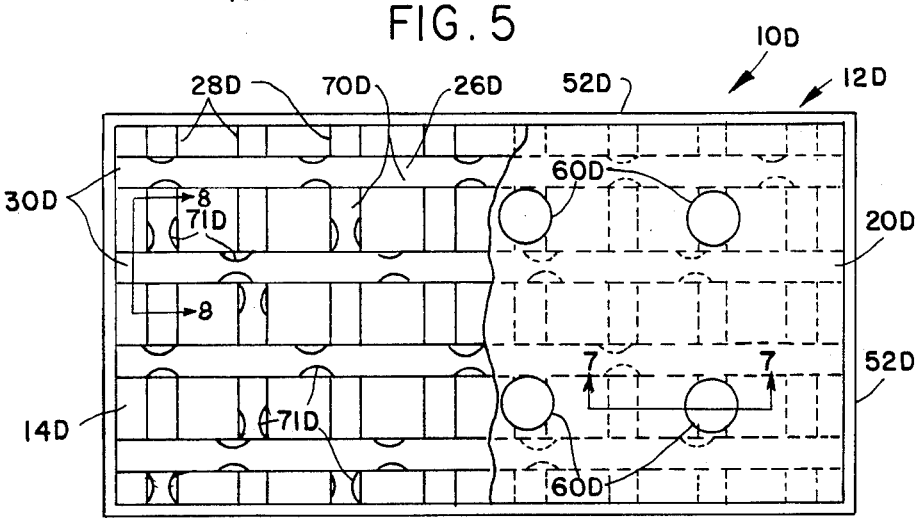
FIG. 6 is a plan view, partially broken away, showing a third embodiment of the invention.
Figure 7:
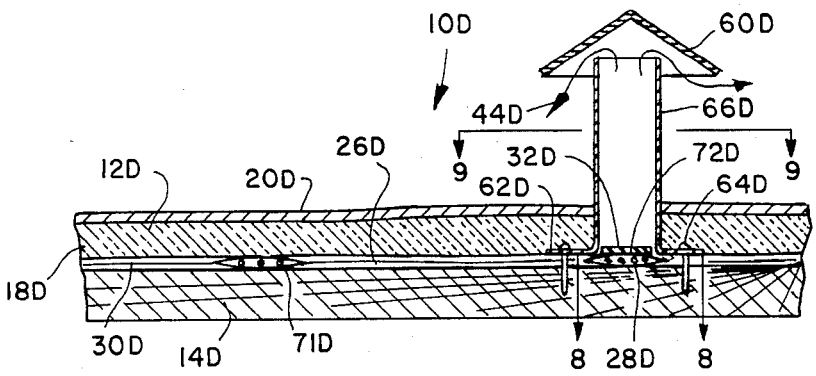
FIG. 7 is an enlarged side sectional view along line 7—7 of FIG. 6.
Figure 8:
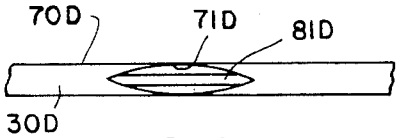
FIG. 8 is an enlarged side view of an aperture shown in FIG. 7.

FIGS. 6–11 show various views of another embodiment of the invention showing the apparatus 10D installed on an insulated roof system 12D supported by a roof deck 14D. In this embodiment, the hydrophilic grid 26D comprises a first set of hydrophilic elements 28D disposed in a transverse relationship relative to a second set of hydrophilic elements 30D. As is more fully shown with reference to FIGS. 7–11, each of the first and second sets of hydrophilic elements 28D and 30D is enclosed in a vapor-impervious shield 70D which may be a metallic, plastic or similar type material, depending upon the desired application and the nature of the hydrophilic grid 26D. Preferably, the first and second sets of hydrophilic elements 28D and 30D may be fashioned from a longitudinally extending roll of hydrophilic material enclosed within the vapor-impervious material 70D. The roll material is individually cut to length and placed upon the roof deck 14D prior to the installation of the insulation 18D and waterproof covering 20D. Each of the longitudinally extending hydrophilic grid elements 28D and 30D includes first aperture means 71D intermittently disposed at preselected distances along the longitudinal length of the hydrophilic grid elements. The first aperture means 71D provides a moisture input to the hydrophilic material. Although the first aperture means 71D are shown disposed on the side of the substantially flat hydrophilic grid element 28D and 30D as best shown in FIG. 8, it is understood that the first aperture means may be disposed at any convenient place along the longitudinal length of the hydrophilic grid elements 28D and 30D. A plurality of vent means 60D are located throughout the roof deck 14D for providing a moisture output for the apparatus.

FIG. 7 is an enlarged sectional view along line 7—7 of FIG. 6 showing the hydrophilic grid generally designated 26D being located on the roof deck 14D with insulation 18D disposed thereon and covered by a waterproof covering 20D. A specific embodiment of the vent means is shown in FIG. 7 as a conventional roof vent 60D having a vent flange 62D fastened through the hydrophilic grid 26D to the roof deck 14D by conventional means such as nails 64D. A second aperture means 72D is disposed in communication with an upstanding pipe 66D to enable the venting of moisture as shown by the arrow 44D.

FIG. 8 is an enlarged side view of a portion of FIG. 7 showing in more detail one of the first apertures 71D disposed in the sidewall of the vapor impervious shield 70D of one of the second hydrophilic elements 30D. The first apertures 71D of the first hydrophilic element 28D is of a similar construction.

Figure 9:
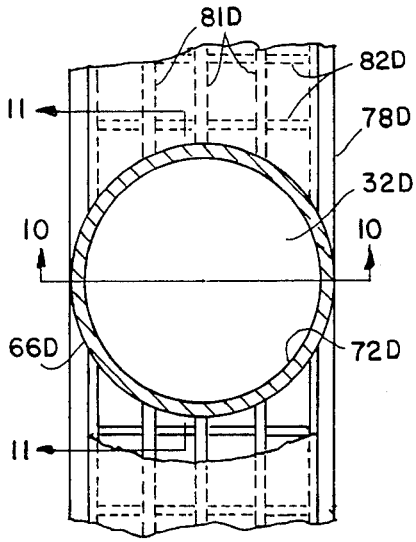
FIG. 9 is an enlarged sectional view along line 9—9 of FIG. 7.

FIG. 9 is an enlarged sectional view along line 9—9 of FIG. 7 showing a solid or continuous third hydrophilic element 32D overlaying the second grid aperture 72D to facilitate the removal of moisture from the hydrophilic grid 26D. As set forth previously, the third hydrophilic element 32D has greater volumetric capacity for moisture than the hydrophilic grid elements 28D and 30D thereby encouraging the movement of moisture by capillary action to the third grid element 32D in addition to encouraging evaporation from the third hydrophilic element 32D.

Figure 10:
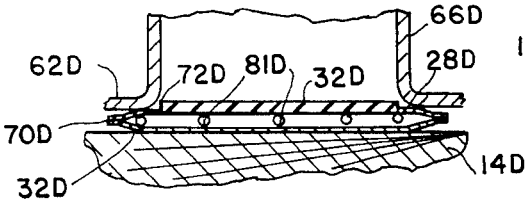
FIG. 10 is a sectional view along line 10—10 of FIG. 9.
Figure 11:
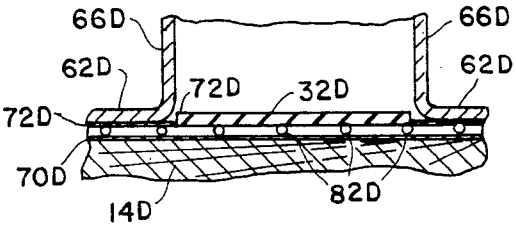
FIG. 11 is a sectional view along line 11—11 of FIG. 9.
Figure 12:
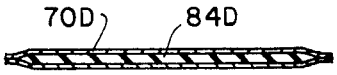
FIG. 12 is a sectional view of a modification of the grid elements shown in FIGS. 7–11.

FIGS. 9–11 are sectional views showing more clearly the position of the third grid element 32D in relation to the hydrophilic grid elements 28D and 30D. It should be noted that each of the hydrophilic grid elements 28D and 30D is composed of transversly disposed hydrophilic fibers 81D and 82D as shown in FIGS. 8–11. The use of the sub-grid of hydrophilic fibers 81D and 82D within the vapor impervious shield substantially reduces the weight, bulk and material cost of the hydrophilic grid elements 71D and 72D. Alternatively, a solid hydrophilic member 84D may be disposed within the vapor-impervious shield as is more fully set forth in FIG. 12. In this embodiment, substantially the entire volume enclosed by the vapor-impervious shield 70D is filled by the solid hydrophilic element 84D. The invention finds usefulness with either the sub-grid or the solid hydrophilic element within the vapor-impervious shield, depending upon the particular application of the moisture area. It should also be appreciated by those skilled in the art that the various venting and various roof structures disclosed herein are changeable and that numerous other arrangements can be resorted to within the teachings of the instant invention.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

The invention claimed is:

1. An apparatus for eliminating moisture in an insulated roof system having a roof deck and insulation disposed thereon covered by a waterproof layer, the improvement comprising:

a grid of hydrophilic material disposed adjacent the insulating layer;

said grid comprising a first set of longitudinally extending hydrophilic elements;

said grid further comprising a second set of longitudinally extending hydrophilic elements disposed in a transverse relationship to said first set of hydrophilic elements enabling moisture to travel along said first and second sets of hydrophilic elements by capillary action, each of said elements of said first and said second set being enclosed within a vapor impervious shield;

first aperture means disposed in said vapor impervious shield enabling moisture to enter therein to input said grid elements;

second aperture means disposed in said vapor impervious shield to enable evaporation of moisture from said grid elements; and means for venting the moisture accumulated in said first and second sets of hydrophilic elements through said second aperture means enabling the moisture accumulated within said grid to flow toward said means for venting thereby reducing the moisture within the moisture prone area.

2. An apparatus as set forth in claim 1, wherein said venting means includes a third hydrophilic element at least partially exposed to the ambient and in communication with at least one of said first and second sets of hydrophilic elements for enabling evaporation of accumulated moisture.

3. An apparatus as set forth in claim 1, wherein said hydrophilic grid is interposed between insulating portions of the roof insulation.

4. An apparatus as set forth in claim 1, wherein the grid is disposed on a surface of the insulation extending substantially parallel to the roof of the building.

5. An apparatus as set forth in claim 1, wherein said vent means includes said second aperture means being disposed in fluid communication with a vent pipe extending through the insulation and the waterproof covering.

6. An apparatus as set forth in claim 1, wherein each of said grid elements includes a sub-grid element disposed in said vapor impervious shield.

7. An apparatus as set forth in claim 1, wherein each of said grid elements includes a substantially solid hydrophilic material disposed in said vapor impervious shield.

8. An apparatus as set forth in claim 2, wherein said third hydrophilic element comprises a solid hydrophilic material disposed about the periphery of the roof and extending along the sidewall of the building with the terminating edge thereof being exposed to the ambient.

9. An apparatus as set forth in claim 2, wherein said third hydrophilic element comprises a solid hydrophilic material in fluid contact with said grid and extending adjacent a preexisting vent in the building system.

10. An apparatus for eliminating moisture within a moisture prone area, comprising in combination:

a grid of hydrophilic material disposed adjacent the moisture prone area;

said grid comprising a first set of longitudinally extending hydrophilic elements disposed in a transverse relationship to said first set of hydrophilic elements enabling moisture to travel along said first and second sets of hydrophilic elements by capillary action, each of said elements of said first and said second set being enclosed within a vapor impervious shield;

first aperture means disposed in said vapor impervious shield enabling moisture to enter therein to input said grid elements;

second aperture means disposed in said vapor impervious shield to enable evaporation of moisture from said grid elements; and means for venting the moisture accumulated in said first and second sets of hydrophilic elements through said second aperture means enabling the moisture accumulated within said grid to flow toward said vent thereby reducing the moisture within the moisture prone area.

* * * * *